US009261812B1

(12) United States Patent
DiGirolamo et al.

(10) Patent No.: US 9,261,812 B1
(45) Date of Patent: Feb. 16, 2016

(54) TONER ADDER ROLL HAVING AN ABRASIVE AGENT ADDITIVE

(71) Applicant: Lexmark International, Inc., Lexington, KY (US)

(72) Inventors: Martin Victor DiGirolamo, Lexington, KY (US); Billie Jo Enciu, Richmond, KY (US); Kelly Ann Killeen, Lexington, KY (US); Kurt Daniel Lambert, Lexington, KY (US); Johnny Dale Massie, II, Lexington, KY (US); Robert Francis Soto, Lexington, KY (US); Donald Wayne Stafford, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/694,456

(22) Filed: Apr. 23, 2015

Related U.S. Application Data

(60) Provisional application No. 62/145,646, filed on Apr. 10, 2015.

(51) Int. Cl.
*G03G 15/08* (2006.01)

(52) U.S. Cl.
CPC ..... *G03G 15/0808* (2013.01)

(58) Field of Classification Search
USPC ..... 399/252, 265, 269, 272, 279, 281; 492/48, 56, 58
See application file for complete search history.

(56) References Cited

U.S. PATENT DOCUMENTS

| | | | | |
|---|---|---|---|---|
| 6,813,470 | B1 | 11/2004 | Elbert et al. | |
| 6,952,550 | B2 * | 10/2005 | Ohkuwa | G03G 15/0808 399/281 |
| 7,627,275 | B2 | 12/2009 | Fish et al. | |
| 7,702,267 | B2 | 4/2010 | Campbell et al. | |
| 2012/0316045 | A1 * | 12/2012 | Tagawa | G03G 15/0233 492/56 |

* cited by examiner

*Primary Examiner* — Hoan Tran
(74) *Attorney, Agent, or Firm* — Justin M Tromp

(57) ABSTRACT

A toner adder roll according to one example embodiment includes an electrically conductive shaft defining an axis of rotation of the toner adder roll. A foam member is cylindrically disposed about the shaft and forms an outer circumferential surface of the toner adder roll. The foam member is composed of a polymeric open-cell foam material. An abrasive agent is dispersed on the outer circumferential surface of the toner adder roll.

20 Claims, 2 Drawing Sheets

TONER ADDER ROLL HAVING AN ABRASIVE AGENT ADDITIVE

CROSS REFERENCES TO RELATED APPLICATIONS

This application claims priority to U.S. Provisional Patent Application Ser. No. 62/145,646, filed Apr. 10, 2015, entitled "Toner Adder Roll having an Abrasive Agent Additive," the content of which is hereby incorporated by reference in its entirety.

BACKGROUND

1. Field of the Disclosure

The present disclosure relates generally to electrophotographic image forming devices and more particularly to a toner adder roll having an abrasive agent additive.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll and a doctor blade are positioned in one replaceable unit referred to as a developer unit. The image forming device's main toner supply, which is consumed relatively quickly in comparison with the life of the components housed in the developer unit, is provided in a reservoir in a separate replaceable unit in the form of a toner cartridge. The toner cartridge periodically supplies toner from its relatively large toner reservoir to a smaller toner reservoir in the developer unit for use in print operations.

One potential limitation on the useful life of the developer unit is the unwanted filming of toner or toner elements on components of the developer unit, such as on the surface of the developer roll. In general, relatively small toner particles may tend to aggregate due to electrostatic charging and film on the outer circumferential surface of the developer roll. Further, mechanical forces on the toner in the developer unit may tend to dislodge one or more elements of the toner (e.g., release agents, colorants, surfactants, dispersants, charge control agents, emulsifiers, plasticizers, etc.) from the toner particles. These dislodged toner elements may be electrostatically attracted to and film on the surface of the developer roll. Developer roll filming may lead to print defects such as the appearance of dark spots, bands or streaks. If unaddressed, developer roll filming may limit the useful life of the developer unit. Accordingly, reduction of toner filming on the surface of the developer roll is desired.

SUMMARY

A toner adder roll according to one example embodiment includes an electrically conductive shaft defining an axis of rotation of the toner adder roll. A foam member is cylindrically disposed about the shaft and forms an outer circumferential surface of the toner adder roll. The foam member is composed of a polymeric open-cell foam material. An abrasive agent is dispersed on the outer circumferential surface of the toner adder roll.

A toner adder roll according to another example embodiment includes an electrically conductive shaft defining an axis of rotation of the toner adder roll. A foam member is cylindrically disposed about the shaft and forms an outer circumferential surface of the toner adder roll. The foam member is composed of a polymeric open-cell foam material and includes a cured coating on the polymeric open-cell foam material. A conductive agent and an abrasive agent are dispersed in the cured coating. The abrasive agent is present in the cured coating at up to 15% by weight of the cured coating and the abrasive agent has an average aggregate particle size of between 2 nm and 100 microns.

A developer unit for an electrophotographic image forming device according to one example embodiment includes a reservoir for storing toner and a developer roll having an outer circumferential surface. The developer unit also includes a toner adder roll that has an electrically conductive shaft defining an axis of rotation of the toner adder roll. The toner adder roll also includes a foam member cylindrically disposed about the shaft and forming an outer circumferential surface of the toner adder roll. The foam member is composed of a polymeric open-cell foam material. The outer circumferential surface of the toner adder roll forms a nip with the outer circumferential surface of the developer roll and is positioned to supply toner from the reservoir to the outer circumferential surface of the developer roll. An abrasive agent is dispersed on the outer circumferential surface of the toner adder roll.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
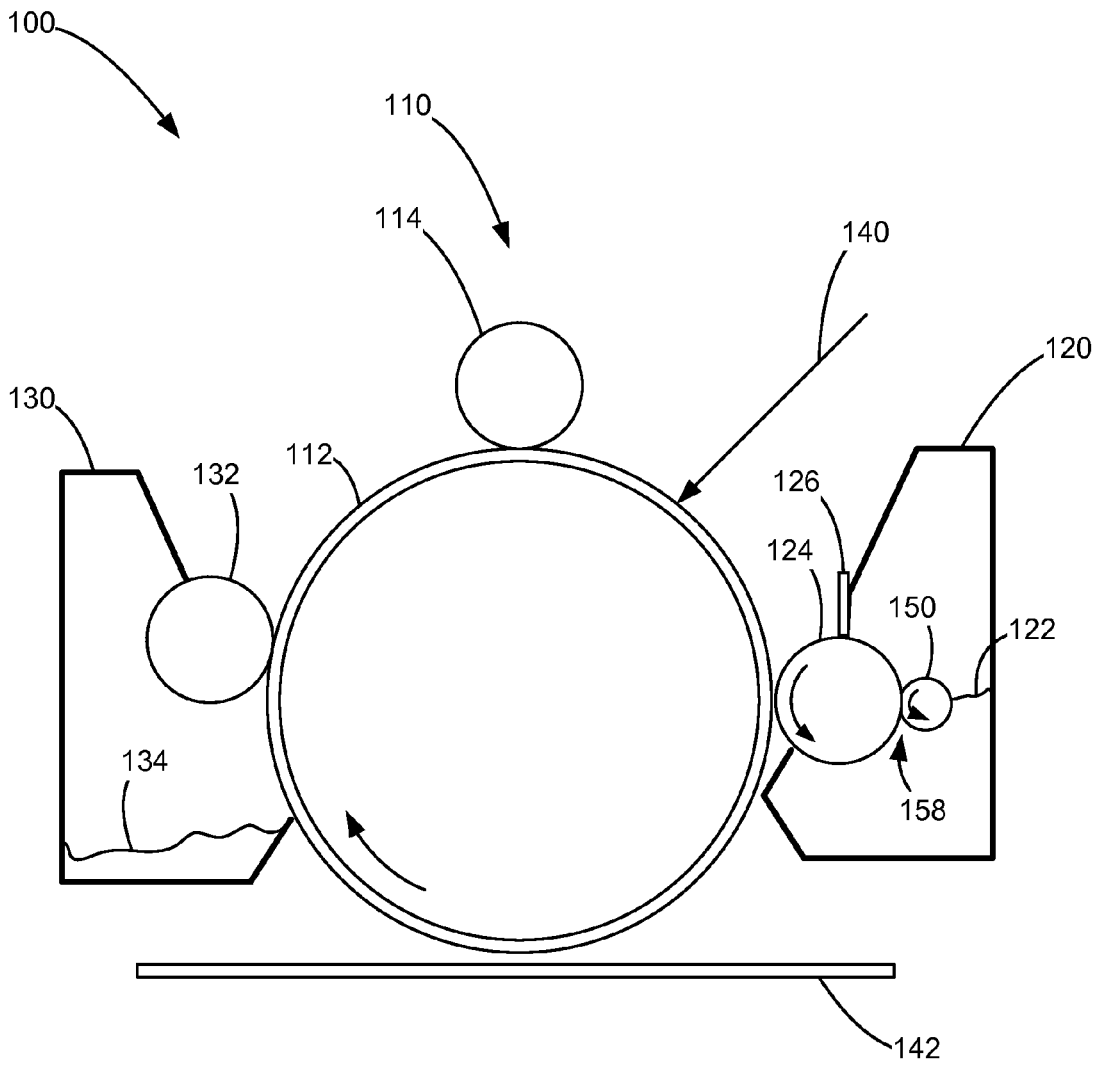
FIG. 1 is a schematic view of an electrophotographic image forming device according to one example embodiment.

Referring now to the drawings and particularly to FIG. 1, an electrophotographic image forming device 100 is shown schematically according to one example embodiment. The electrophotographic printing process is well known in the art and, therefore, is described briefly. During a print operation, a charge roll 114 charges the surface of a photoconductive drum 112 to a predetermined voltage. Charge roll 114 and photoconductive drum 112 together form a photoconductor unit 110. The charged surface of photoconductive drum 112 is then selectively exposed to a laser light source 140 to selectively discharge the surface of photoconductive drum 112 and form an electrostatic latent image on photoconductive drum 112 corresponding to the image being printed. Charged toner from a developer unit 120 is picked up by the latent image on photoconductive drum 112 creating a toned image.

Developer unit 120 includes a toner reservoir 122 having toner particles stored therein. A toner adder roll 150 and a developer roll 124 are mounted in toner reservoir 122. Toner adder roll 150 supplies toner stored in toner reservoir 122 to developer roll 124 and scrubs off unused toner from developer roll 124. Developer roll 124 is electrically charged and electrostatically attracts the toner particles supplied by toner adder roll 150. In one embodiment, toner adder roll 150 and developer roll 124 rotate in the same rotational direction such that their adjacent surfaces move in opposite directions to charge the toner transferred from the toner adder roll 150 to developer roll 124. A doctor blade 126 positioned along developer roll 124 provides a substantially uniform layer of toner on developer roll 124. As developer roll 124 and photoconductive drum 112 rotate, toner particles are electrostatically transferred from developer roll 124 to the latent image on photoconductive drum 112 forming a toned image on the surface of photoconductive drum 112. In one embodiment, developer roll 124 and photoconductive drum 112 rotate in opposite rotational directions such that their adjacent surfaces move in the same direction to facilitate the transfer of toner from developer roll 124 to photoconductive drum 112.

The toned image is then transferred from photoconductive drum 112 to print media 142 (e.g., paper) either directly by photoconductive drum 112 or indirectly by an intermediate transfer member (not shown). A fusing unit (not shown) fuses the toner to print media 142. A cleaning roll 132 (or cleaning blade) of a cleaner unit 130 removes any residual toner adhering to photoconductive drum 112 after the toner is transferred to print media 142. Waste toner removed by cleaning roll 132 is held in a waste toner reservoir 134 in cleaner unit 130. The cleaned surface of photoconductive drum 112 is then ready to be charged again and exposed to laser light source 140 to continue the printing cycle.

The components of image forming device 100 are replaceable as desired. For example, in one embodiment, photoconductor unit 110, developer unit 120 and cleaner unit 130 are housed in a replaceable unit with the main toner supply of image forming device 100. In another embodiment, photoconductor unit 110, developer unit 120 and cleaner unit 130 are provided in a first replaceable unit while the main toner supply of image forming device 100 is housed in a second replaceable unit. In another embodiment, developer unit 120 is provided with the main toner supply of image forming device 100 in a first replaceable unit and photoconductor unit 110 and cleaner unit 130 are provided in a second replaceable unit. In another embodiment, the main toner supply of image forming device 100 is housed in a first replaceable unit, developer unit 120 is housed in a second replaceable unit and photoconductor unit 110 and cleaner unit 130 are housed in a third replaceable unit. It will be appreciated that any other combination of replaceable units may be used as desired. Further, in the case of an image forming device configured to print in color, separate replaceable units may be used for each toner color. For example, in one embodiment, the image forming device includes four photoconductor units 110, developer units 120 and cleaner units 130, each corresponding to a particular toner color (e.g., black, cyan, yellow and magenta) and each replaceable as discussed above.

Figure 2A:
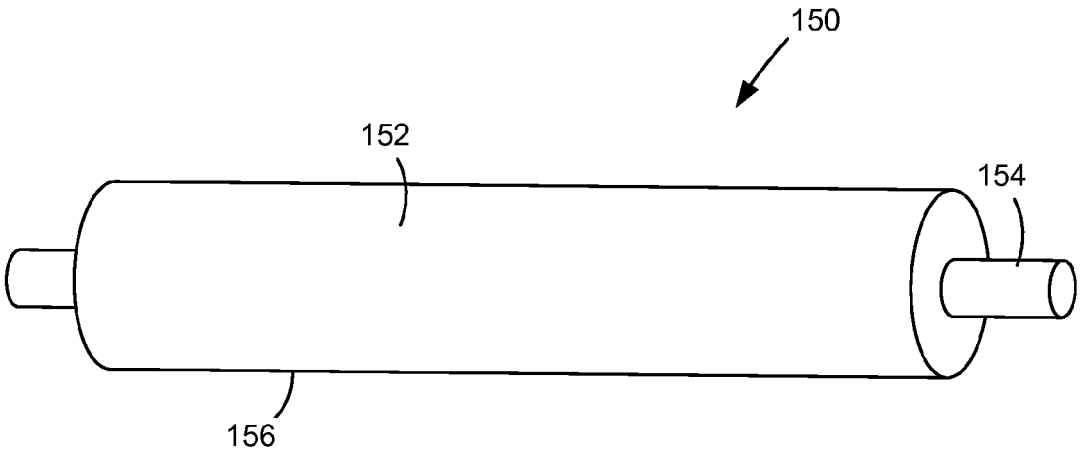
FIG. 2A is a perspective view of a toner adder roll according to one example embodiment.
Figure 2B:
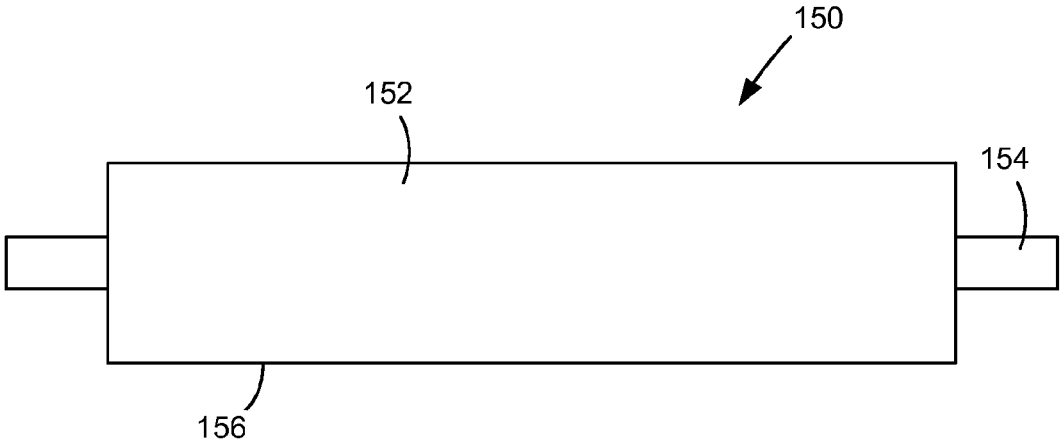
FIG. 2B is a front elevation view of the toner adder roll shown in FIG. 2A.
Figure 2C:
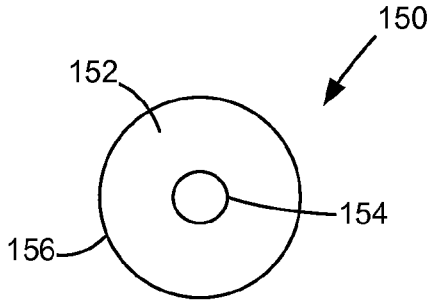
FIG. 2C is a side elevation view of the toner adder roll shown in FIGS. 2A and 2B.

FIGS. 2A-2C show an example toner adder roll 150. Toner adder roll 150 includes a flexible polymeric foam member 152 cylindrically disposed about a shaft 154. Foam member 152 forms the outer circumferential surface 156 of toner adder roll 150. Foam member 152 may include a single layer of foam material formed on shaft 154 or multiple layers of foam material cylindrically disposed about and attached to each other with an innermost layer of foam material formed on shaft 154. Toner adder roll 150 is multi-functional with respect to developer roll 124. Toner adder roll 150 supplies a controlled amount of toner from reservoir 122 to developer roll 124 and scrubs unused toner off of the outer surface of developer roll 124 so that toner is substantially uniformly distributed on the outer surface of developer roll 124. The portion of outer circumferential surface 156 in contact with developer roll 124 forms a dented nip 158 (FIG. 1). The contact pressure of nip 158 aids in triboelectrically charging the toner particles supplied by toner adder roll 150 to developer roll 124. A power source supplies a predetermined electrical bias to the shafts of developer roll 124 and toner adder roll 150, generating an electrical field between the two and causing charged toner on toner adder roll 150 to be attracted to developer roll 124.

Shaft 154 of toner adder roll 150 may be formed of any suitable electrically conductive material. Conductive material may include metal such as aluminum, aluminum alloys, stainless steel, iron, nickel, copper, etc. or a conductive polymeric material such as an inherently conductive polymer or a polymer having a conductive additive.

Foam member 152 of toner adder roll 150 is composed of an open-cell polymeric foam material. Cellular material having an open-cell structure is one in which the cells communicate with each other. In some embodiments, the polymeric foam material has a density of between 25 g/L and 150 g/L, such as between 60 g/L and 80 g/L. In some embodiments, the porosity the polymeric foam material is between 30 pores/inch and 120 pores/inch, such as between 70 pores/inch and 90 pores/inch. The porosity of the polymeric foam material may be measured by examining the polymeric foam material under a microscope and counting the number of foam cells in a linear inch.

Processes suitable for the formation of an open-cell polymeric foam are well known in the art. The polymeric foam material may be formed using a conventional slabstock or molding process. Foam member 152 may be composed of polymeric materials such as, for example, polyurethane silicone, nitrile, ethylene-propylene, ethylene-propylene-diene, butadiene, styrene-butadiene, isoprene and natural rubbers or combinations thereof. In one embodiment, foam member 152 is composed of an open-cell polyurethane foam, such as a polyether or polyester based polyurethane foam. For polyurethane foam, production is based on the reaction of an isocyanate with a molecule comprising either an alcohol or amine functional group as a source of active hydrogen. To form a polyurethane polymer, di- or polyisocyanates are reacted with polyfunctional compounds, typically polyols. Foam cell formation may be based on the reactions of isocyanate with water to form an aromatic amine and carbon dioxide with the carbon dioxide causing the cell formation and foaming. Polymeric foam cells may also be formed by introducing a chemical blowing agent that releases a gas, such as nitrogen and/or carbon dioxide, to the polymeric foam material when the polymeric foam material is in a liquid state. The foam cells may also be formed by injecting a gas, such as air, to the polymeric foam material when the polymeric foam material is in a liquid state and frothing the liquid at high speed. The cured foam material may be cut into sleeves according to the desired shape and size of foam member 152 and adhered to shaft 154. The adhered foam material may then be ground to its final dimensions.

Foam member 152 of toner adder roll 150 is sufficiently flexible to compress at nip 158 and sufficiently resilient to spring back to substantially the original circumferential circular shape when it is no longer in the nip area. In some embodiments, foam member 152 has a compression force deflection of between 0.05 N and 0.80 N, such as between 0.10 N and 0.30 N. The compression force deflection value is measured by compressing foam member 152 at a rate of 5 mm/min and recording the force at 1 mm of compression at a temperature of 22° C.±2° C. and relative humidity of 50%±20%.

Flexible polymeric foams, and polyurethane foams in particular, are typically electrical resistors. Accordingly, in some embodiments, foam member 152 includes one or more conductive agents that render foam member 152 electrically conductive in order to generate the desired electrical field between toner adder roll 150 and developer roll 124 to facilitate the transfer of toner from toner adder roll 150 to developer roll 124.

In some embodiments, the conductive agent(s) are included in the polymeric foam material. In other embodiments, a coating containing the conductive agent(s) is applied to the polymeric foam material. The coating may be applied to the polymeric foam material by any suitable method such as, for example, dip or spray coating. The conductive agent includes any suitable conductive material or combination of materials that renders foam member 152 electrically conductive. The conductive agent may include, for example, carbon black or other carbon based material such as carbon nanoparticles, carbon fibers, graphite, graphene, inherently conductive polymers, ionic additives, metal particles and combinations thereof. The ionic additive(s) may include, for example, $LiPF_6$, $LiAsF_6$, $LiClO_4$, $LiBF_4$, $LiCF_3SO_3$, $LiN(SO_2CF_3)_2$, $LiC(SO_2CF_3)_3$, $LiPF_3(C_2F_5)$, $Cs(CF_3COCH_2COCF_3)$ (abbreviated as CsHFAc), $KPF_6$, $NaPF_6$, $CuCl_2$, $FeCl_3$, $FeCl_2$, $Bu_4NPF_6$, $Bu_4NSO_3CF_3$, $Bu_4NCl$, $Bu_4NBr$ or dimethylethyldodecylammonium ethosulfate. The inherently conductive polymer(s) may include, for example, polyaniline, poly(3-alkylthiophenes), poly(p-phenylenes), or poly(acetylenes). In one embodiment, the coating includes a carbon based material, such as carbon black, dispersed in an acrylic or polyurethane coating base.

In some embodiments, toner adder roll 150 has an electrical resistance of less than 8.0 log(ohm), such as less than 4.0 log(ohm) at 1 volt. The electrical resistance of toner adder roll 150 is measured using a multi-meter with foam member 152 compressed 1 mm at a temperature of 22° C.±2° C. and relative humidity of 50%±20%.

An abrasive agent is dispersed on at least the outer circumferential surface 156 of foam member 152 of toner adder roll 150. The abrasive agent aids in scrubbing away filmed deposits on the outer circumferential surface of developer roll 124 in order to reduce toner filming on the surface of developer roll 124. Accordingly, the abrasive agent may reduce the occurrence of print defects resulting from toner filming on the surface of developer roll 124 and may thereby extend the useful life of developer unit 120. In addition, the abrasive agent may permit the use of a softer polymeric foam material in foam member 152 in comparison with a toner adder roll 150 that does not include the abrasive agent. The use of a softer polymeric foam material may reduce the occurrence of toner filming on developer roll 124 and other components of developer unit 120, such as doctor blade 126, by reducing the mechanical forces on the toner in developer unit 120. The use of a softer polymeric foam material may also reduce the heat generated at nip 158.

The abrasive agent may include any suitable additive that enhances the ability of foam member 152 to abrade away filmed deposits on the outer circumferential surface of developer roll 124. The abrasive agent may include, for example, silicon dioxide (also referred to as silica), aluminum oxide (also referred to as alumina), titanium dioxide (also referred to as titania), silicon carbide, ceramic material or combinations thereof. The abrasive agent may be dispersed directly in the polymeric foam material, in the coating discussed above containing the conductive agent(s) or in a separate coating applied to the polymeric foam material.

In some embodiments, the abrasive agent is dispersed in the coating containing the conductive agent(s) prior to its application to the polymeric foam material. In one embodiment where the abrasive agent is dispersed in the coating, the abrasive agent is present in foam member 152 at up to 15% by weight of the final cured coating including all values and increments therebetween, such as, for example, between 1% and 15% of the final cured coating weight, between 2.5% and 12.5% of the final cured coating weight, between 4% and 9% of the final cured coating weight, and at about 6.5% of the final cured coating weight. The abrasive agent has an average aggregate particle size of between 2 nm and 100 μm including all values and increments therebetween, such as, for example, between 1 μm and 20 μm, between 4 μm and 9 μm, and an average aggregate particle size of 6.5 μm. In one embodiment, the abrasive agent includes 6.5 μm silica dispersed in a coating that includes carbon black and an acrylic or polyurethane coating base. It is believed that providing the abrasive agent in a coating material that is applied to the polymeric foam material better ensures that the abrasive agent is present on the outer circumferential surface 156 of foam member 152 in comparison with providing the abrasive agent directly in the polymeric foam material. It is preferred that the abrasive agent is present on at least outer circumferential surface 156 of foam member 152 of toner adder roll 150 in position to directly contact and scrub away toner elements or other deposits on the surface of developer roll 124.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner adder roll, comprising:

an electrically conductive shaft defining an axis of rotation of the toner adder roll;

a foam member cylindrically disposed about the shaft and forming an outer circumferential surface of the toner adder roll, the foam member is composed of a polymeric open-cell foam material; and an abrasive agent dispersed on the outer circumferential surface of the toner adder roll.

2. The toner adder roll of claim 1, wherein the polymeric open-cell foam material is a polyurethane foam material.

3. The toner adder roll of claim 1, wherein the abrasive agent includes at least one of silica, alumina, titania, silicon carbide and ceramic.

4. The toner adder roll of claim 3, wherein the abrasive agent includes silica.

5. The toner adder roll of claim 1, wherein the abrasive agent is dispersed in the polymeric open-cell foam material.

6. The toner adder roll of claim 1, wherein the foam member includes a cured coating on the polymeric open-cell foam material and the abrasive agent is dispersed in the cured coating.

7. The toner adder roll of claim 6, wherein the abrasive agent is present in the cured coating at between 2.5% and 12.5% by weight of the cured coating.

8. The toner adder roll of claim 6, wherein the foam member includes a conductive agent dispersed in the cured coating.

9. The toner adder roll of claim 1, wherein the abrasive agent includes an average aggregate particle size of between 1 micron and 20 microns.

10. A toner adder roll, comprising:

an electrically conductive shaft defining an axis of rotation of the toner adder roll;

a foam member cylindrically disposed about the shaft and forming an outer circumferential surface of the toner adder roll, the foam member is composed of a polymeric open-cell foam material and includes a cured coating on the polymeric open-cell foam material; and a conductive agent and an abrasive agent dispersed in the cured coating, wherein the abrasive agent is present in the cured coating at up to 15% by weight of the cured coating and the abrasive agent has an average aggregate particle size of between 2 nm and 100 microns.

11. The toner adder roll of claim 10, wherein the abrasive agent includes at least one of silica, alumina, titania, silicon carbide and ceramic.

12. The toner adder roll of claim 11, wherein the abrasive agent includes silica.

13. The toner adder roll of claim 10, wherein the abrasive agent is present in the cured coating at between 2.5% and 12.5% by weight of the cured coating.

14. The toner adder roll of claim 10, wherein the abrasive agent includes an average aggregate particle size of between 1 micron and 20 microns.

15. A developer unit for an electrophotographic image forming device, comprising:

a reservoir for storing toner;

a developer roll having an outer circumferential surface; and a toner adder roll having:

an electrically conductive shaft defining an axis of rotation of the toner adder roll;

a foam member cylindrically disposed about the shaft and forming an outer circumferential surface of the toner adder roll, the foam member is composed of a polymeric open-cell foam material, the outer circumferential surface of the toner adder roll forms a nip with the outer circumferential surface of the developer roll and is positioned to supply toner from the reservoir to the outer circumferential surface of the developer roll; and an abrasive agent dispersed on the outer circumferential surface of the toner adder roll.

16. The developer unit of claim 15, wherein the abrasive agent includes at least one of silica, alumina, titania, silicon carbide and ceramic.

17. The developer unit of claim 15, wherein the foam member includes a cured coating on the polymeric open-cell foam material and the abrasive agent is dispersed in the cured coating.

18. The developer unit of claim 17, wherein the abrasive agent is present in the cured coating at between 2.5% and 12.5% by weight of the cured coating.

19. The developer unit of claim 17, wherein the foam member includes a conductive agent dispersed in the cured coating.

20. The developer unit of claim 15, wherein the abrasive agent includes an average aggregate particle size of between 1 micron and 20 microns.

* * * * *